US005904349A

United States Patent [19]

Dykstra

[11] Patent Number: 5,904,349

[45] Date of Patent: May 18, 1999

[54] PUSH-PULL CLAMP

[75] Inventor: Henry Dykstra, Hartland, Mich.

[73] Assignee: Delaware Capital Formation, Inc., Wilmington, Del.

[21] Appl. No.: 08/905,707

[22] Filed: Aug. 5, 1997

[51] Int. Cl.[6] ..... B25B 1/14

[52] U.S. Cl. ..... 269/228; 269/201

[58] Field of Search ..... 269/228, 201; 74/106

[56] References Cited

U.S. PATENT DOCUMENTS

| | | | |
|---|---|---|---|
| 2,574,281 | 11/1951 | Olson | 269/228 |
| 3,735,972 | 5/1973 | Blatt | 269/228 |
| 3,819,171 | 6/1974 | Sendoykas et al. | 269/228 |
| 3,912,251 | 10/1975 | Fraser et al. | 269/228 |
| 5,772,193 | 6/1998 | Dykstra | 269/228 |

FOREIGN PATENT DOCUMENTS

| | | | |
|---|---|---|---|
| 8706869 | 11/1987 | Japan | 269/228 |

*Primary Examiner*—Timothy V. Eley
*Assistant Examiner*—Daniel G. Shanley
*Attorney, Agent, or Firm*—Dinnin & Dunn, P.C.

[57] ABSTRACT

A plunger clamp capable of locking in either a retracted or extended position having a rigid body slidably supporting an elongated plunger. A bifurcated lever is pivotally connected inside the body and to a V shaped link arm, the link arm is pivotally connected to the plunger where the link arm translates the angular motion of the lever to drive the plunger between the retracted and extended positions. Essentially the entire linkage assembly is housed in cavities formed by the body during actuation of the lever.

6 Claims, 2 Drawing Sheets

Fig-1
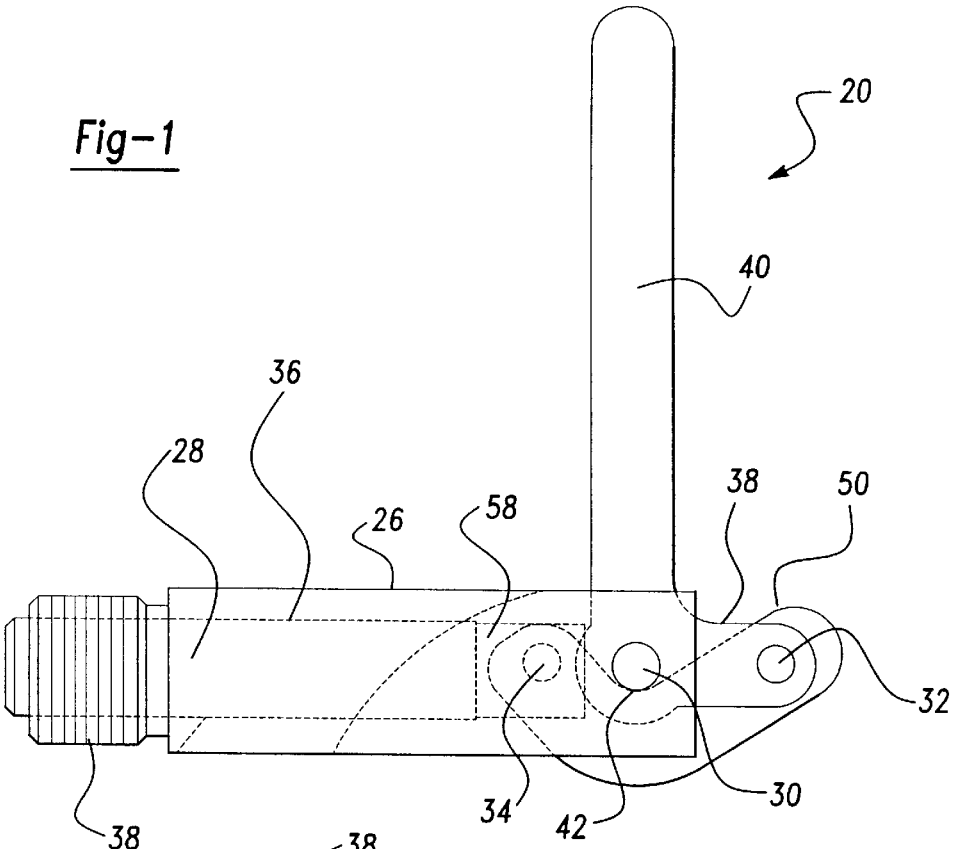
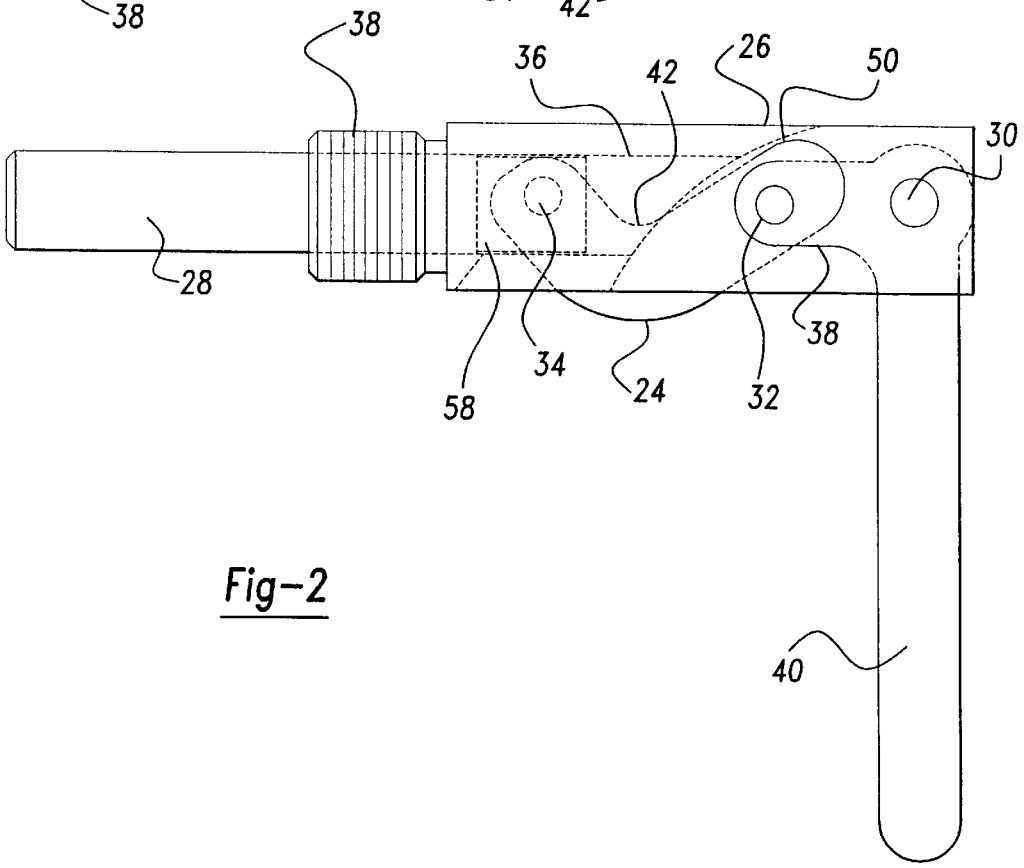
Fig-2

PUSH-PULL CLAMP

FIELD OF THE INVENTION

The present invention broadly relates to a plunger clamp apparatus, and more particularly, relates to a plunger clamp assembly having a body for support and stability.

BACKGROUND OF THE INVENTION

Plunger clamps have been long known in the industry and act to provide a lever arm connected through a linkage to move a cylindrical plunger. The linkage generally consists of three pivot points all in the same plane as the motion of the plunger. Additionally, the linkage members all have substantially linear designs with longitudinal axes in line with the pivot points when the plunger is in either a push or pull position. An example of this type of device is manufactured by De-Sta-Co company, Model 604.

The design of such devices create problems. First, the mechanical advantage of the typical plunger clamp, that is, the correlation between the force applied to the handle and resulting reaction force to the plunger, is so great that the linkage is routinely over-stressed during normal use causing the linkage to fail.

Second, the linkage design of the typical plunger clamp uses rivets to make pivotal connections, routinely connecting only two members at a time. This type of connection has unbalanced forces resulting in a torquing force on the rivet. Accordingly, if the connected members of the plunger are not machined properly, within low tolerances, the stress on the rivets during normal use is increased to a level resulting in rivet failure.

Wherefore, it is an object of the present invention to provide a design of a plunger clamp having a mechanical advantage that does not over-stress the linkage during normal use.

Another object of the present invention is to provide a design of a plunger clamp with pivotal connections using full cross pins to lessen torquing forces at the pivotal connections, and thereby, preventing the failure of pivotal connections.

Additional objects, advantages and novel features of the invention will be set forth in part in the description which follows, and in part will become apparent to those skilled in the art upon examination of the following or may be learned by practice of the invention. The objects and the advantages of the invention may be realized and obtained by means of the instrumentalities and combinations particularly pointed out in the appended claims.

SUMMARY OF THE INVENTION

According to the present invention, the foregoing and other objects and advantages are obtained by a plunger clamp having a rigid body that forms a linear bearing to slidably support an elongated plunger within one end of the body, and the opposite end of the body essentially forms a rectangular cavity to allow a bifurcated lever to be pivotally mounted inside the body with a full cross pin at a first axis. Having the lever mounted inside the rigid body greatly increases the stability of the lever and prevents twisting under normal conditions of the work environment.

A link arm essentially shaped as a V is pivotally connected to a lateral extension of the lever at a second axis and pivotally connected to the plunger at a third axis in which the link arm translates the angular motion of the lever to drive the plunger along a longitudinal axis between a retracted and extended position responsive to movement of the lever.

The plunger has a rectangular forked end with the link arm positioned between the forked ends for the pivotal connections at the third axis, the forked ends having smaller dimensions than the diameter of the plunger to allow this pivotal connection to enter the linear bearing. Accordingly, the linear bearing need not be enlarged to accommodate this pivotal connection effectively maximizing support for the plunger.

This linkage design: the V-shaped link arm, the forked plunger end, and the lateral extension of the lever reduces stress in the linkage by decreasing the mechanical advantage of the clamp and allows for full cross pins to be used as pivotal connections. Additionally, this design has three pivotal connections instead of five to simplify the manufacture of the clamp. Finally, a substantial portion of the linkage is housed in the cavity of the body to protect the linkage during use of the present invention in the work place.

BRIEF DESCRIPTION OF THE DRAWINGS

FIG. 1 is a side view of the present invention with the plunger clamped in a retracted position.

FIG. 2 is a side view similar to FIG. 1 showing the plunger clamped in an extended position.

Figure 3:
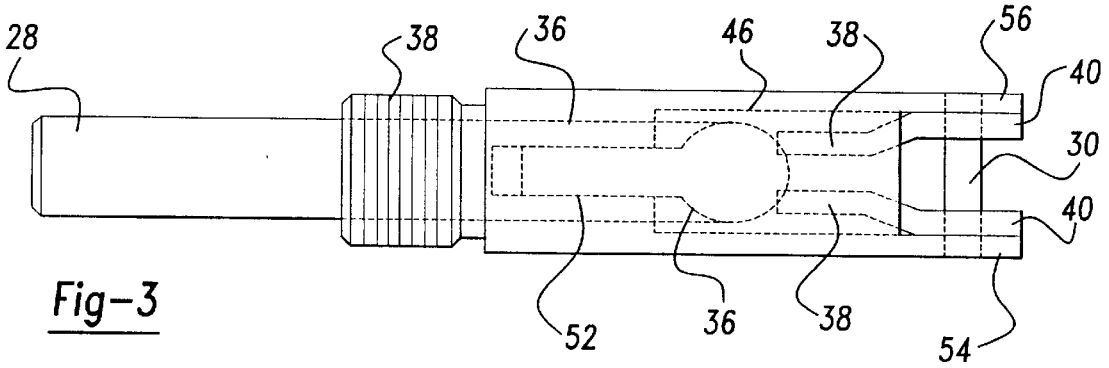
FIG. 3 is a top view of FIG. 1.

DESCRIPTION OF THE PREFERRED EMBODIMENT(S) AND BEST MODE OF CARRYING OUT THE INVENTION

Referring now in greater detail to the drawings, FIG. 1 illustrates a plunger clamp 20 in accordance with the present invention. Said clamp 20 includes a body 26 having a threaded end 38, said body 26 forms a linear bearing 36 to slidably support an elongated plunger 28, said plunger 28 actuated by a link arm 24 pivotally connected at full cross pin 34 to plunger 28 and pivotally connected to a bifurcated lever 40 at full cross pin 32 of a lateral extension 38 of said lever 40, said lever 40 having a second pivotally connection at full cross pin 30 to end of said body 26 opposite to threaded end 38.

Figure 7:
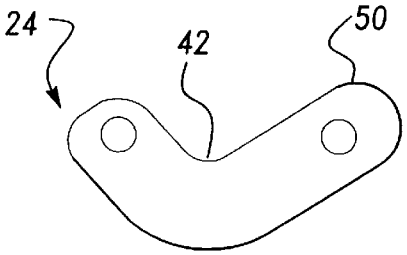
FIG. 7 is a side view of the link arm of the present invention.
Figure 8:
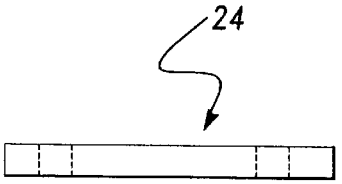
FIG. 8 is top view of the link in FIG. 7.

FIGS. 7–8 illustrates an embodiment of the actuating link arm 24 having essentially a V-shape with an inside curvature 42. FIG. 1 illustrates the present invention in a retracted position where lever 40 is essentially perpendicular to the longitudinal axis of plunger 28, with cross pin 32 slightly above a plane formed by cross pins 30, 34 and the longitudinal axis of plunger 28 effectively locking the plunger over center. In this position, curvature 42 of link arm 24 rests securely against cross pin 30 to prevent further movement of lever 40 toward the body 26.

FIGS. 2–3 illustrates the plunger clamp 20 in the extended position. From the position of FIG. 1, lever 40 is rotated about the axis of cross pin 30 through a path away from the body 26 such that the lever 40 is once again essentially perpendicular to the longitudinal axis of plunger 28. This actuation of the lever translates the axis of cross pin 32 from a point outside body 26 as positioned in FIG. 1 through a path with a final position inside body 26 between cross pins 30 and 34. Cross pin 32 moves slightly past a plane defined by pins 30, 34 and the longitudinal axis of plunger 28 to lock the plunger over center with end 50 of link 24 resting against cavity 46 of body 26.

Figure 4:
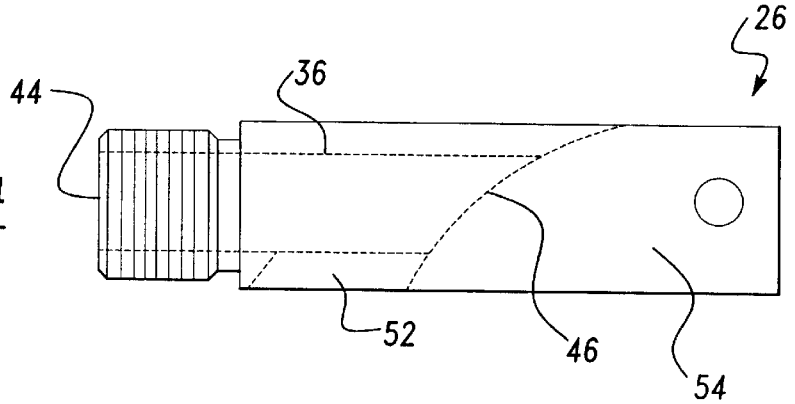
FIG. 4 is a side view of the body of the present invention.
Figure 5:
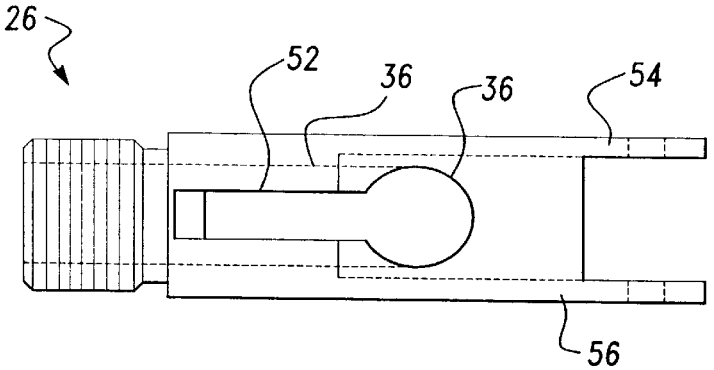
FIG. 5 is a bottom view of the body in FIG. 4.
Figure 6:
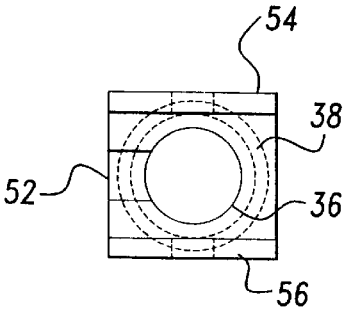
FIG. 6 is an end view of FIG. 5.

FIGS. 4–6 illustrates cavities 46, 52 and a linear bearing 36 formed by the body 26 to allow maximum travel of the link arm 24 and plunger 28 and to house the linkage assembly. This embodiment of body 26 is essentially rectangular with linear bearing 36 traversing half the length of body 26, with linear bearing 36 having a rectangular cavity portion 52 to allow link arm 24 to move through body 26. The rest of body 26 is essential open having two sides 54, 56 where lever 40 is pivoted at cross pin 30 inside body 26.

Plunger 28 is essentially cylindrical with the end at cross pin 34 having a pair of rectangular forks 58 of smaller dimensions than the diameter of plunger 28 allowing the forks 58 to travel through the linear bearing 36 uninhibited. The forks are spaced apart leaving just enough room for link arm 24 to be securely positioned between the forks and pivotally fastened with cross pin 34. The present embodiment of plunger 28 is internally threaded capable of receiving threaded adjustment knobs (not shown) allowing adjustment of the throw of plunger 28.

What is claimed is:

1. A plunger clamp comprising:

a body formed from a single bar of steel having a square cross section and longitudinally having a rectangular cross section, said body defines a bore through a first end and cavity at the second end, the bore communicating with said cavity, said cavity defined by rectangular sides and top portion, said top portion defining an opening at the second end of the body, a partial bottom portion defining a slot proximate to said first end and communicating with the bore and cavity of said body;

a cylindrical plunger slidably held through said bore of the body;

a lever pivotally connected to the body at the second end;

an arcuate link arm pivotally connected between said plunger and lever, said arcuate link arm positioned in the same plane established through the longitudinal axis and vertical relative to the body;

an axial extension at the first end of said body, said axial extension defining a bore longitudinally aligned and communicating with the bore of said body, said axial extension having a plurality of axially-spaced exterior threads; and full cross pins at each pivotal connection.

2. The plunger clamp of claim 1 having a retracted position established by the plunger being positioned in the body and locked over center, the inside curvature of the arcuate link arm abutting the cross pin pivotally connecting the lever to the body, and the lever positioned generally perpendicular to the longitudinal axis of the body inside the opening of the top portion.

3. The plunger clamp of claim 2 having an extended position established by the plunger projecting from the body and locked over center the arcuate lock arm partially resting inside the slot of said body, and the lever positioned generally perpendicular to the longitudinal axis of the body after having rotated approximately 180° from the retracted position.

4. The plunger clamp of claim 3 wherein said plunger defines a longitudinal bore.

5. The plunger clamp of claim 4 wherein said plunger further includes axially-spaced interior threads in said longitudinal bore of the plunger.

6. A plunger clamp comprising:

a body formed from a single bar of steel having a square cross section and longitudinally having a rectangular cross section, said body defines a bore through a first end and cavity at the second end, the bore communicating with said cavity, said cavity defined by rectangular sides and top portion, said top portion defining an opening at the second end of the body, a partial bottom portion defining a slot proximate to said first end and communicating with the bore and cavity of said body;

a cylindrical plunger slidably held through said bore of the body, said plunger defining a longitudinal bore;

a lever pivotally connected to the body at the second end;

an arcuate link arm pivotally connected between said plunger and lever, said arcuate link arm positioned in the same plane established through the longitudinal axis and vertical relative to the body;

an axial extension at the first end of said body, said axial extension defining a bore longitudinally aligned and communicating with the bore of said body, said axial extension having a plurality of axially-spaced exterior threads;

full cross pins at each pivotal connection; and said plunger further includes axially-spaced interior threads in said longitudinal bore of the plunger.

* * * * *